United States Patent [19]

Binford et al.

[11] Patent Number: 4,909,202

[45] Date of Patent: Mar. 20, 1990

[54] FRUSTOCONICAL VALVE STEM SEALING ELEMENT

[75] Inventors: J. Dudley Binford; Philip L. Bond; David F. Fiedler; Ivan J. Bruns, all of Richmond, Ind.

[73] Assignee: Dana Corporation, Toledo, Ohio

[21] Appl. No.: 373,429

[22] Filed: Jun. 30, 1989

[51] Int. Cl.[4] ..... F01L 3/00

[52] U.S. Cl. ..... 123/188 P; 123/189

[58] Field of Search ..... 123/188 P; 277/189, 277/170, 178, 152

[56] References Cited

U.S. PATENT DOCUMENTS

| | | | |
|---|---|---|---|
| 2,157,867 | 5/1939 | Robertson et al. | 123/188 P |
| 3,379,445 | 4/1968 | Fisher | 277/178 |
| 3,442,517 | 5/1969 | Skinner, Sr. | 123/188 P |
| 3,450,411 | 7/1969 | Skinner | 103/188 P |
| 3,498,621 | 3/1970 | Wilson | 277/152 |
| 3,498,622 | 3/1970 | Belart | 277/170 |
| 3,531,134 | 9/1970 | Kammeraad | 277/181 |
| 3,554,180 | 1/1971 | Lesser | 277/189 |
| 3,599,992 | 8/1971 | Kammeraad | 277/189 |
| 3,699,942 | 10/1972 | Moray | 123/188 P |
| 3,771,800 | 11/1973 | Wilson et al. | 277/186 |
| 4,502,696 | 3/1985 | Kammeraad | 277/12 |
| 4,773,363 | 9/1988 | Stritzke | 123/188 P |
| 4,811,704 | 3/1989 | Boehmer et al. | 123/188 P |
| 4,834,037 | 5/1989 | Lafever | 123/188 P |

FOREIGN PATENT DOCUMENTS

| | | | |
|---|---|---|---|
| 866665 | 4/1961 | United Kingdom | 123/188 P |

*Primary Examiner*—E. Rollins Cross

*Attorney, Agent, or Firm*—F. B. McDonald

[57] ABSTRACT

A valve stem seal assembly includes a rigid cylindrical shell and an annular resilient seal body contained entirely within the shell. Integral to the seal body is a frustoconical sealing element adapted to engage a valve guide of an internal combustion engine. The sealing element converges radially inwardly, and upon installation of the assembly on a valve guide the outer surface of the sealing element bends further radially inwardly to effectively seal the top surface of the guide. The seal body includes a stem sealing aperture, which in one preferred embodiment is designed to engage the valve stem without a spring. In a same or similar embodiment, the shell contains a circumferential array of tangs for retention of the assembly on the guide.

10 Claims, 1 Drawing Sheet

FRUSTOCONICAL VALVE STEM SEALING ELEMENT

BACKGROUND OF THE INVENTION

This invention relates to valve stem seals utilized in intake and exhaust manifolds of internal combustion engines. More particularly, this invention relates to sealing elements in valve stem seals which assure against oil leakage at the tops of valve guides.

Internal combustion engines contain intake and exhaust valves, each valve including a head and a stem integrally fixed to the head, and reciprocally mounted in a guide. As the valve stem ordinarily operates in a substantial volume of oil, much effort is directed to limiting the amount of oil consumed by the engine. In order to control oil consumption, valve seals are mounted on valve guides to meter oil flow between the stems and guides.

A significant number of valve stem seal assemblies include a metallic casing or shell adapted to retain a resilient seal member, typically made of an elastomer or a polytetrafluoroethylene base material. Much effort has been directed to the shape of the resilient portion of the seal, particularly to the extent that the seal must not only engage the stem, but must also directly engage a portion of the valve guide itself.

A major problem in designing seals relates to tolerance variations encountered in the manufacture of seal assembly parts. Tolerance variations in the valve assembly casings designed for securement to valve guides affect those portions of the seal which engage the valve guide and valve stem. Thus, inadequate sealing caused by tolerance variations may result in excessive oil consumption, notwithstanding the purpose of the seal. Several designs have been offered to compensate for tolerance variations, but none have been found to be fully satisfactory.

SUMMARY OF THE INVENTION

The valve stem seal assembly of the present invention includes a valve stem sealing element designed to accommodate cumulative tolerance variations between the valve guide and seal assembly. The assembly includes a rigid cylindrical shell which has an endwall defining an aperture for receiving a valve stem. Frictionally retained within the shell is an annular resilient seal body, preferably formed of elastomer, from which extends a frustoconical sealing element adapted for engagement with the top of a valve guide. The sealing element converges inwardly toward a longitudinal axis of the shell within a range of 30 to 60 degrees in its free and unrestrained state. Upon installation, the frustoconical element bends radially inwardly as an outboard sealing surface of the element engages the annular top surface of the guide.

The elastomer seal body contains at least one annular rib extending circumferentially about the body and adapted to frictionally engage the interior of the shell. In one preferred form, the seal body is designed and sized to assure sealing of the valve stem without a traditional garter spring. The shell may also contain a circumferential array of tangs for securement of the assembly to a valve guide.

DETAILED DESCRIPTION OF PREFERRED EMBODIMENTS

Figure 1:
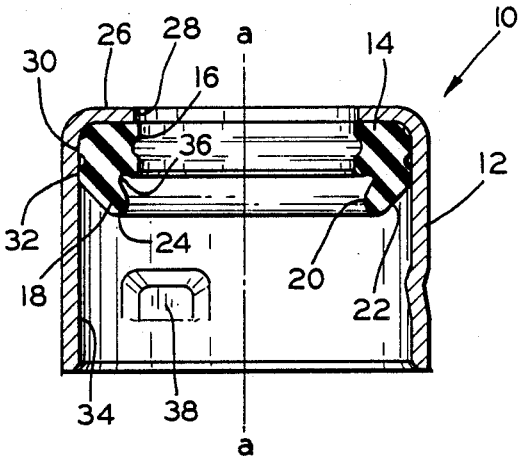
FIG. 1 is a cross-sectional side view of one preferred embodiment of a valve stem seal assembly constructed in accordance with the present invention, shown in its free and unrestrained state.
Figure 2:
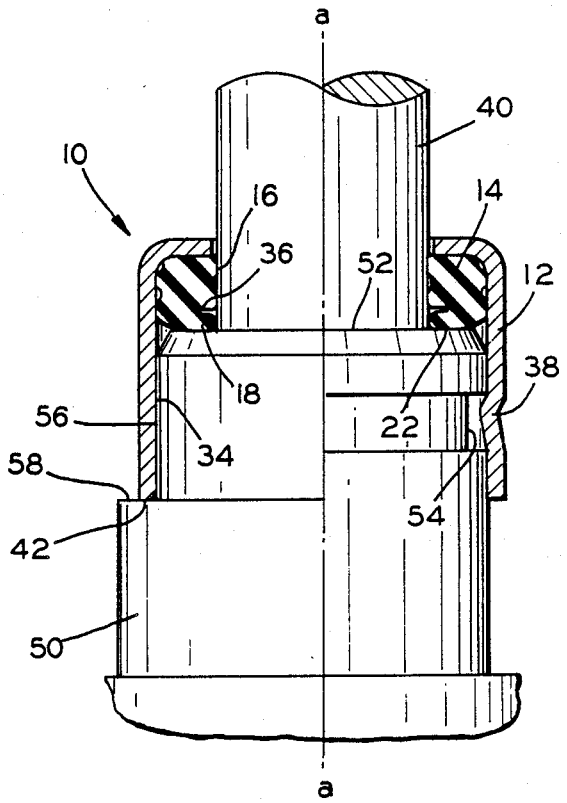
FIG. 2 is a cross-sectional side view of the preferred embodiment of FIG. 1, after the assembly has been installed over a valve stem and valve guide.

Referring initially to FIGS. 1 and 2, a first preferred embodiment of a valve stem seal assembly 10 is shown having a two-piece construction consisting of a rigid cylindrical casing or shell 12 and a resilient seal body 14. The sea body 14 is formed of an elastomer, and is frictionally retained within the preferably metallic shell 12. The body 14 contains a circumferential sealing surface 16 defined by an aperture as shown. The sealing surface 16 is adapted to sealingly engage a valve stem 40 in order to control oil consumption associated with the reciprocal movement of the stem 40 in a valve guide 50, as will be appreciated by those skilled in the art. In the preferred form, the surface 16 is formed of a plurality of annular lips.

Extending radially inwardly toward a longitudinal axis "a—a" of the shell 12 is a frustoconical sealing element 18. In the preferred form, the sealing element 18 is integral With the seal body 14, and tends to collapse into an annular ring upon installation as shown in FIG. 2, although the latter degree of bending is unnecessary to achieve an effective seal. FIGS. 1 and 2 show the relative positions of the sealing element prior to and after installation of the seal assembly 10 on the cylindrical valve guide 50 of an internal combustion engine (not shown).

The element 18 comprises an elongate inboard surface 20 and an opposed elongate outboard surface 22. The outboard surface 22 is adapted to make sealing contact with a radially extending annular top surface 52 of the valve guide 50. The inboard and outboard surfaces 20, 22 converge to form an arcuate apex 24 which facilitates radially inward bending of the sealing element 18 upon installation (FIG. 2).

The rigid cylindrical shell 12 has an endwall 26 adapted for axial retention of the resilient seal body 14 within the shell 12. The endwall 26 has an aperture 28 which accommodates a valve stem passage through and into the interior of the seal assembly 10. The circumferential exterior 30 of the seal body 14 has at least one annular rib 32, sized for interference fit with the cylindrical interior wall 34 of the shell 12. The latter is for retention of the seal body in the shell during shipment.

As earlier noted, the frustoconical sealing element 18 extends radially inwardly, preferably within a range of 30 to 60 degrees, relative to the axis "a—a" of the shell 12 in its free and uncompressed state. When installed, the element 18 collapses radially inwardly at an elbow 36 located at the interface of the element and the seal body 14. The outboard surface 22 of the sealing element 18 provides a sealing contact with the top 52 of the valve guide over a range of angles. In the practice of this invention, it is not necessary that the frustoconical element 18 be bent entirely perpendicularly to the axis "a-a" as shown. The seal is designed to be effective at any angle between the free and uncompressed state of the element up to the practical limit of the bend as shown in FIG. 2.

In the embodiment of FIGS. 1 and 2, the retention of the shell 12 on the valve guide 50 may be effected by a variety of methods, two of which are shown for convenience in FIG. 2. At the left hand portion of FIG. 2 retention is by means of a friction fit between the interior cylindrical wall 34 of the shell 12 and the cylindrical exterior 56 of the valve guide. Under the latter arrangement, the lower extremity 42 of the shell 12 bottoms against an annular step 58 on the valve guide 50. Referring to the right hand portion of FIG. 2, retention is by means of a circumferential array of tangs 38 in the interior cylindrical wall 34 of the shell 12. The tangs engage a groove 54 in the guide 50.

Figure 3:
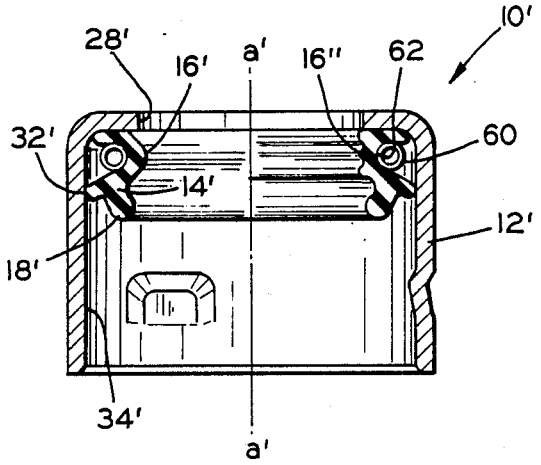
FIG. 3 is a cross-sectional side view of a second preferred embodiment of the valve stem seal of the present invention, shown in a free and unrestrained state.
Figure 4:
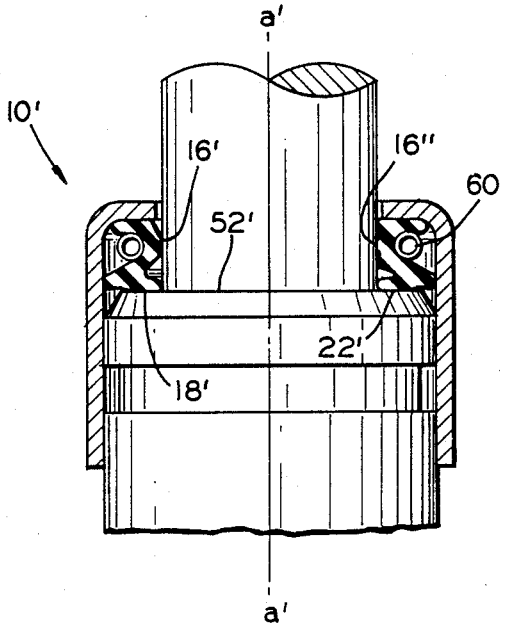
FIG. 4 is a cross-sectional side view the preferred embodiment of FIG. 3, shown installed over a valve stem and valve guide.

Referring now to FIGS. 3 and 4, a second preferred embodiment 10' of a valve stem seal assembly is shown. The embodiment of FIGS. 3 and 4 is similar to that of FIGS. 1 and 2 except for the several features now described.

First, a single annular rib 32' is sized for interference fit with the interior wall 34' of the shell 12', and provides substantially the only frictional retaining force for holding the seal body 14' in the shell 12' prior to assembly. Secondly, a garter spring 60, supported in an exterior groove 62 of the resilient seal body 14', is used to provide a compressive force between the seal body and stem. Thirdly, a more bulbous sealing element 18' is utilized, although by reference to FIG. 4, it will be appreciated that the element 18' functions substantially in the same way as the element 18 of FIGS. 1 and 2. Finally, the lefthand portions of FIGS. 3 and 4 show an alternate single lip 16', which may be utilized in lieu of the multiple lip surfaces 16 and 16" otherwise shown.

Although only two preferred embodiments have been shown and described herein, the following claims envision numerous additional embodiments which will fall within the spirit and scope thereof.

What is claimed is:

1. In a valve stem seal assembly adapted for securement to a valve guide of an internal combustion engine, said assembly including a rigid cylindrical shell defining a longitudinal axis and having an endwall containing an aperture for receiving a valve stem, said assembly having an annular resilient seal body contained within said shell; an improvement comprising said seal body having a frustoconical sealing element integral with said resilient seal body, said element adapted for engagement with a radially extending annular surface on said valve guide, said element converging radially inwardly with respect to said axis in its free and unrestrained state.

2. The valve stem seal assembly of claim 1 wherein said resilient seal body has an aperture therethrough coaxially aligned with said longitudinal axis, said aperture defining a sealing surface adapted for engagement with a reciprocating valve stem, and wherein said sealing element is adapted to bend radially inwardly upon securement of said seal assembly to said valve guide, thereby becoming substantially orthogonal therewith.

3. The valve stem seal assembly of claim 2 wherein said sealing element comprises an inboard sealing surface positioned adjacent said valve stem, and an outboard sealing surface positioned adjacent an interior wall of said shell, wherein said outboard surface sealingly engages said annular surface of said guide upon said radially inward bending of said element, wherein said element converges angularly inwardly within a range of thirty to sixty degrees with respect to said longitudinal axis in its free and unrestrained state.

4. The valve stem seal assembly of claim 3 wherein said seal body further comprises at least one annular rib extending circumferentially about said body, said rib adapted to frictionally engage said interior wall of said shell.

5. The valve stem seal assembly of claim 4 wherein said seal body and said integral frustoconical sealing element are entirely contained within the interior of said shell.

6. The valve stem seal assembly of claim 5 wherein said shell further comprises means for securement of said shell to a valve guide.

7. The valve stem seal assembly of claim 6 wherein said means for securement is a circumferential array of tangs formed in said interior wall of said shell.

8. The valve stem seal assembly of claim 6 wherein said inboard sealing surface and said outboard sealing surface converge at an arcuate apex.

9. The valve stem seal assembly of claim 8 wherein said sealing aperture in said resilient seal body comprises a plurality of radially disposed serrations.

10. The valve stem seal assembly of claim 9 wherein said resilient body contains a spring extending circumferentially about said stem sealing aperture, said spring engaging the exterior of said body.

* * * * *